United States Patent [19]

Bolte et al.

[11] Patent Number: 5,042,681

[45] Date of Patent: Aug. 27, 1991

[54] COMPARTMENTED EASY OPEN PACKAGE

[75] Inventors: Georg Bolte, Vechelde; Dieter Heinecke, Wendeburg; Gunter Hexel, Brunswick, all of Fed. Rep. of Germany

[73] Assignee: Schmalbach-Lubeca AG, Braunschweig, Fed. Rep. of Germany

[21] Appl. No.: 463,366

[22] Filed: Jan. 11, 1990

[30] Foreign Application Priority Data

Jan. 19, 1989 [DE] Fed. Rep. of Germany ..... 3901482

[51] Int. Cl.[5] ..... B65D 17/40

[52] U.S. Cl. ..... 220/276; 220/359; 206/628; 229/120.03; 229/123.1; 229/123.2; 229/125.35

[58] Field of Search ..... 229/123.1, 123.2, 125.35, 229/120.03; 426/114, 119, 120, 122; 206/628; 220/276, 359

[56] References Cited

U.S. PATENT DOCUMENTS

| | | | |
|---|---|---|---|
| 2,878,128 | 3/1959 | Jorgenson | 426/114 |
| 3,069,273 | 12/1962 | Wayne | 206/628 |
| 3,158,491 | 11/1964 | Farrell et al. | 206/628 |
| 3,159,303 | 12/1964 | Betner | 206/628 |
| 3,185,578 | 5/1965 | Scharre | 426/122 |
| 3,298,505 | 1/1967 | Stephenson | 206/628 |
| 3,298,593 | 1/1967 | Stephenson | 206/628 |
| 3,854,653 | 12/1974 | Engelsberger | 206/633 |
| 4,834,247 | 5/1989 | Oghima et al. | 229/125.35 |

*Primary Examiner*—Stephen P. Garbe

*Attorney, Agent, or Firm*—Herbert Dubno; Andrew Wilford

[57] ABSTRACT

An easy-open package has a vessel having an annular peripheral rim and at least one crosswise rib forming with the rim a plurality of upwardly open compartments, a foil engaging the generally coplanar upper edges of the rim and rib of the vessel, formed with a tear line extending around the rim, and provided with an open tab attached to the foil within the tear line, and respective rim and rib hermetic bonds securing the upper edges of the rim and rib to the foil. When the individual compartments are to be kept separate, the foil is formed with an annular tear line around each such compartment and is provided within each tear line with a respective such open tab.

10 Claims, 6 Drawing Sheets

COMPARTMENTED EASY OPEN PACKAGE

FIELD OF THE INVENTION

The present invention relates to an easy-open package. More particularly this invention concerns such a package formed with several compartments for separate items.

BACKGROUND OF THE INVENTION

A standard easy-open package comprises a vessel having a flat rim and a profiled or planar cover foil that is bonded to the vessel along an annular seal strip at the rim, the vessel and the foil being made of a synthetic resin, a metal, or a laminate of the two materials. The vessel and foil together form one or more compartments that can contain respective foodstuffs, although it is within the scope of this invention for other types of materials to be thus packaged. As a rule the foil and vessel are bonded together, either by a weld or an adhesive, along the rim, that is the outer periphery of the vessel. The bond is made weak enough that the foil can be removed without tearing yet strong enough to keep the contents hermetically contained. This clearly creates for the manufacturer the problem of trading off ease of opening against sealing. Another problem is that it is possible for different materials, typically foodstuffs, to slip from one compartment to another between the top of a rib or web separating one compartment from the adjacent one.

It is also known to form the cover foil with a tear line that extends around the compartments, just within the inner edge of its periphery and with an open or lift tab attached to the foil within the tear line. The tab is pulled up away from the vessel to strip that portion of the cover foil that lies inside the tear line from the package. Such an arrangement is fairly difficult to make, in particular when the vessel is to have several compartments.

OBJECTS OF THE INVENTION

It is therefore an object of the present invention to provide an improved compartmented easy-open package.

Another object is the provision of such an improved compartmented easy-open package which overcomes the above-given disadvantages, that is which is easy and inexpensive to manufacture and that keeps the contents of the individual compartments segregated.

SUMMARY OF THE INVENTION

An easy-open package according to the invention has a vessel having an annular peripheral rim and at least one crosswise rib forming with the rim a plurality of upwardly open compartments, a foil engaging the generally coplanar upper edges of the rim and rib of the vessel, formed with a tear line extending around the rim, and provided with an open tab attached to the foil within the tear line, and respective rim and rib hermetic bonds securing the upper edges of the rim and rib to the foil.

Thus each compartment can contain, for example, a different portion of a food stuff that will be held completely separate from the other portions, preventing blending of flavors. When according to this invention the holding power of the rim bonds is substantially greater than the holding power of the web bonds the tear line runs around the rim outside all the compartments and the entire meal can be exposed at one time by simply tearing out the entire section delimited by the tear line. In such an arrangement the rim bond can be made very strong so that the package is extremely durable and easy to handle, yet it will in no way interfere with opening the package because the edge portion of the foil remains stuck to the rim. Such a package therefore avoids the tradeoff between tight sealing and ease of opening.

When the individual compartments are to be kept separate, the foil is formed with an annular tear line around each such compartment and is provided within each tear line with a respective such open tab. This makes it possible to open them one at a time without the opening of one compartment damaging the seal of an adjacent compartment.

In one such arrangement according to the invention at least one of the tabs is an independent element anchored to the foil within the respective tear line. This makes it possible for the compartments to have any shape and orientation, one even being wholly confined between ribs within a group of others.

It is also possible according to this invention for at least one of the tabs to be unitarily formed with the foil and to be defined between extensions of the respective tear line. Such an arrangement is particularly cheap to manufacture. In particular the one tab can extend over a rib separating the compartment of the respective tear line from an adjacent compartment. This adjacent compartment in this case can be a separate pocket defined by an auxiliary rib. It is also possible for the tab of one compartment to actually overlie an adjacent compartment so that when this adjacent compartment is opened the tab is made accessible.

In accordance with further features of the invention each tear line of each compartment has two extensions extending over the rim of the vessel to an outer periphery and flanking the respective tab, the tabs overhanging the rim of the vessel. Furthermore the vessel rim is formed with respective flaps underlying and bonded to the tabs. These flaps can immediately border each other and be fastened to each other.

DESCRIPTION OF THE DRAWINGS

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
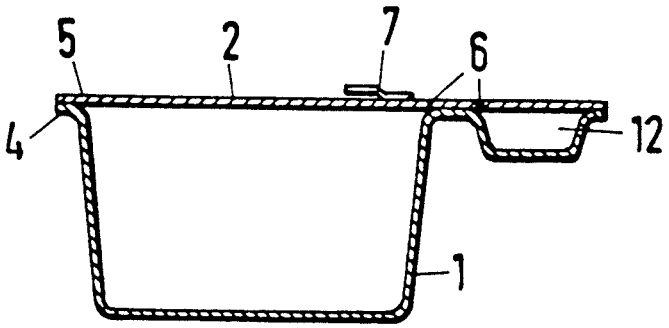
FIG. 1 is a vertical section through a package according to this invention.
Figure 2:
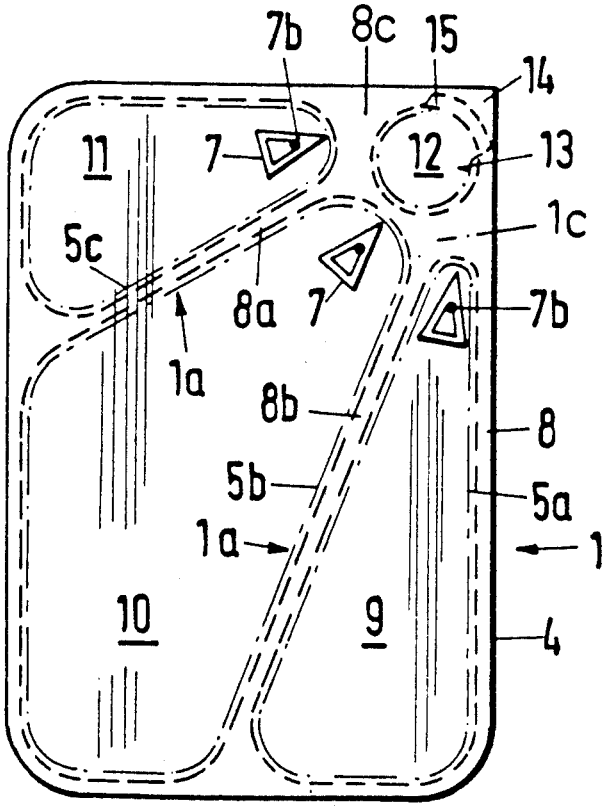
FIG. 2 is a top view of the package of FIG. 1.

As seen in FIGS. 1 and 2 a metal/plastic laminate vessel 1 has a generally rectangular outer periphery or rim 4 and is covered by a generally rectangular cover foil 2. The vessel 1 is formed within the rim 4 with ribs 1*a*, 1*b*, and 1*c* that define four upwardly open pocket-like compartments 9, 10, 11, and 12. The foil is bonded via a relatively strong bond 8 to the periphery and via relatively weak bonds 8*a*, 8*b*, and 8*c* to the ribs 1*a*, 1*b*, and 1*c*. The bonds can be made adhesively, but here are made by fusing together the synthetic-resin laminas of the vessel 1 and foil 2.

In addition the foil 1 is formed within the periphery of each compartment 9, 10, and 11 with a respective annular tear line 5*a*, 5*b*, and 5*c* and within the border of the small circular corner pocket 12 with a tear line 13 that extends to the edge of the package. The sections of the foil 1 that are delimited by the tear lines 5*a*, 5*b*, and 5*c* are provided with respective pull tabs 7 that are attached at 7*b*, for instance by an adhesive or welding, to the foil 1. Thus the compartments 9, 10, and 11 can be opened independently.

In addition a corner 14 of the package at the pocket 12 can be broken off at a score or tear line 15 to allow the foil to be ripped off over the pocket 12. This system is described in more detail below with reference to FIGS. 8 through 11.

Figure 3:
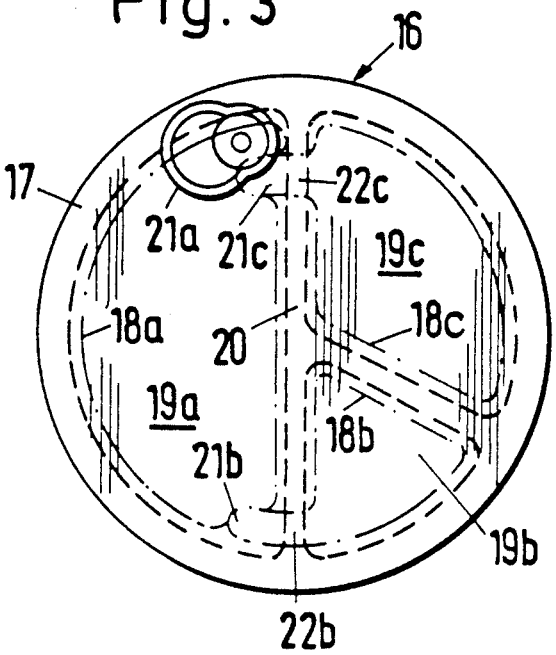
FIGS. 3 and 4 are top views of other packages according to this invention.

The system of FIG. 3 has a vessel 16 covered by a circular foil 17 and subdivided by ribs 20 into three compartments 19*a*, 19*b*, and 19*c*. Tear lines 18*a*, 18*b*, and 18*c* extend around the peripheries of each of these compartments 19*a*, 19*b*, and 19*c*, and the lines 18*b* and 18*c* have lobular extensions projecting at 21*b* and 21*c* over the rib 20 into the compartment 19*a*. The foil within the line 18*a* of the compartment 19*a* is provided with a separate pull tab 21*a*. In this arrangement, therefore, the tab 21*a* is pulled to strip the foil over the compartment 19*a* and free the two tabs 21*b* and 21*c*. Then these tabs 21*b* and 21*c* can be pulled up to break the weak seal at the locations 22*b* and 22*c* and strip the foil off within the respective tear lines 19*b* and 19*c*.

Figure 6:
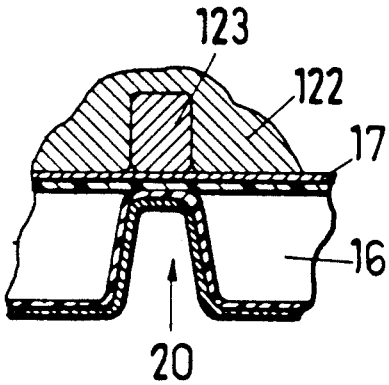
FIGS. 6 and 7 are vertical sections illustrating the manufacture of the bonds according to this invention.
Figure 7:
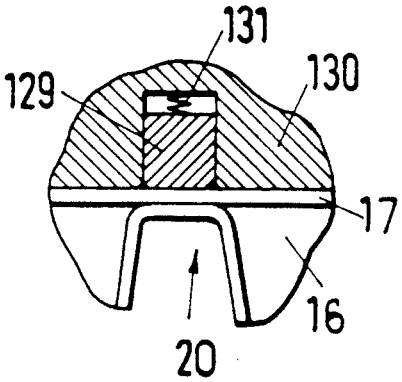

In order to facilitate separation at the regions on the web 20 where the ribs 22*b* and 22*c* connect the tabs 21*b* and 21*c*to the respective foil sections, the bond underneath these ribs 22*b* and 22*c* is made relatively weak. This is achieved either as shown in FIG. 6 by means of a tool 122 having at the region corresponding to the rib 21*b* and 21*c* an insulating plug 123 that ensures that the welding temperature here will be lower and, therefore, the bond weaker. It is also possible as shown in FIG. 7 for a welding tool 130 to have an insert 129 loaded by a spring 131 so that it bears with less force in the region of the rib 21*b* or 21*c*, also creating a bond at this location with less grip or holding power.

Figure 13:
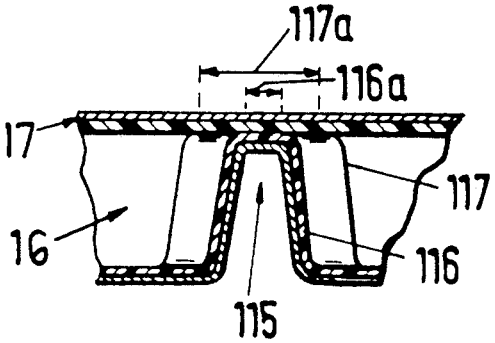
FIGS. 13 and 14 are a vertical section and top view of a detail of the package of FIG. 12.
Figure 14:
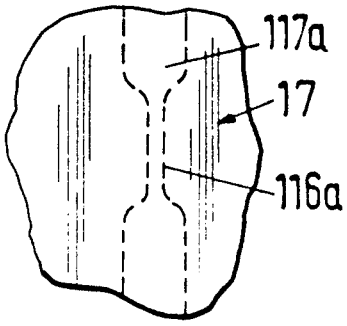

FIGS. 13 and 14 show another arrangement where a rib 115 has normal-width regions 117 of width 117*a* interrupted at locations where the ribs 21*b* or 21*c* will engage them by narrow-width sections 116 of a relatively narrow width. Thus in these narrow-width sections 116 the bond will have less area and, even if made with the same heat, temperature, and time as elsewhere will inherently be less strong.

Figure 15:
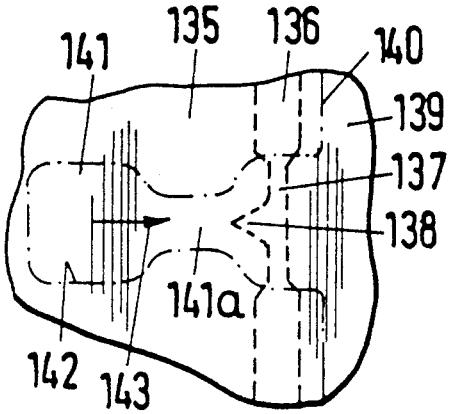
FIGS. 15 and 16 are top views of a variation on the system of FIGS. 13 and 14.
Figure 16:
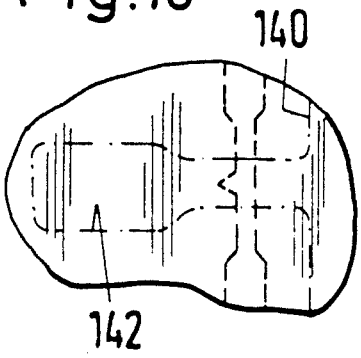

Furthermore as shown in FIGS. 15 and 16 it is possible for a foil to have a section 139 in a compartment delimited by a tear line 140 extended at 142 outside the compartment in another foil section 135 to define a pull tab 141 and a rib 141*a* that are bonded to a narrow section 137 of a rib 136. To facilitate separation the narrow portion 137 is formed with a point directed away from the compartment section 139 of the foil. In FIG. 15 the rib 141*a* has a width roughly equal to the length of the narrow section 137 and in FIG. 16 its width is substantially narrower.

Figure 17:
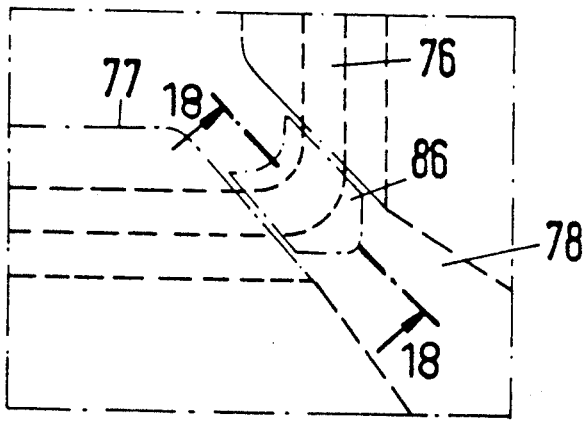
FIG. 17 is a detail of a further package in accordance with the invention.
Figure 18:
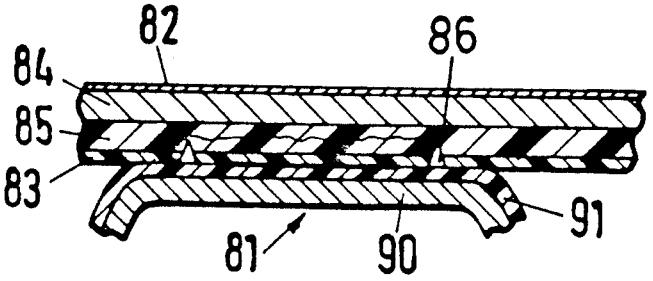
FIG. 18 is a section taken along line 18—18 of FIG. 17.

Similarly, FIGS. 17 and 18 show a foil 75 that has four layers: an aluminum core 84, a protective paint layer 82 on the upper face of the core 84, a hot-bonding layer 83, and a stripping layer 85 that secures the bond layer 83 to the metal layer 84 with a relatively weak bond. A tear line 77 is cut through the paint layer 82 and part way through the aluminum layer 85. In addition an annular tear line 86 is cut through the bond layer 83 and at least part of the way through the stripping layer 85 in the region of the tab 78. This line 86 extends along the inside and outside of a seal or attachment strip 76 and also across it generally underneath the upper tear line 77.

FIG. 18 shows how the vessel 81 is formed of a base layer 90 of aluminum carrying a coating 91 of a synthetic resin that will bond with a very strong bond to the layer 83, normally being of the same thermoplastic resin as this layer 83. Thus when the tab 78 of the system of FIGS. 17 and 18 is lifted the foil 75 will tear along the lines 86 and 77, separating from the foil 75 a patch of itself that will rip loose generally long line L of FIG. 10, that is somewhere between the foil 84 and the bond layer 83. Due to the weak bond created by the layer 85 such separation will be relatively easy to effect, making opening the container similarly easy. Once the corner is separated as described, further tearing takes place along line 77 to open up the package.

Figure 5:
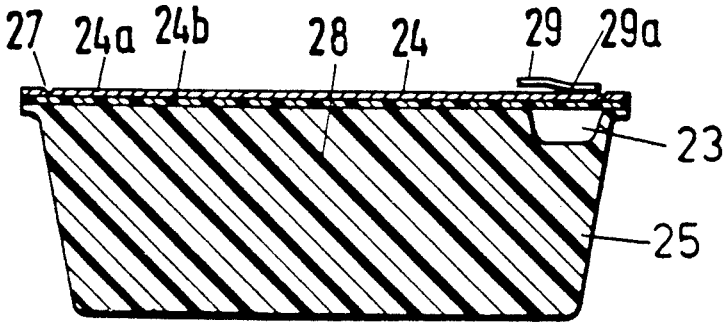
FIG. 5 is a section taken along line 5—5 of FIG. 4.
Figure 4:
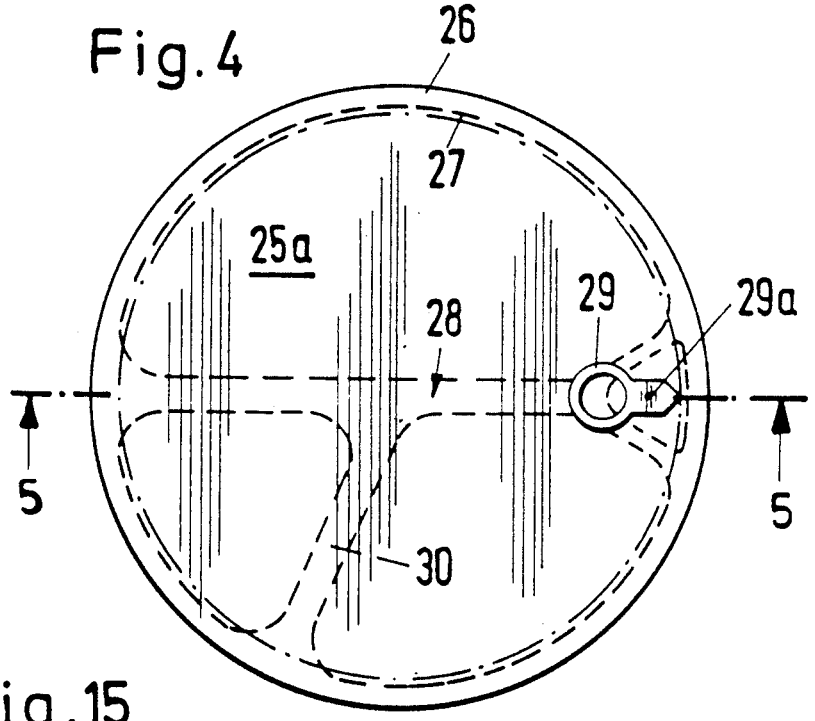

In FIGS. 4 and 5 a vessel 25 is formed with ribs 28 and 30 and a rim 26 and is bonded at the rim 26 by means of a very strong bond to a circular cover foil 24 comprised of a metal layer 24 and a synthetic resin 24*b* and at the ribs 28 and 30 by a relatively weak bond. The cover foil 24 is formed with a circular tear line 27 extending just inside the rim 26 and cut only through the metal layer 24*a*. The rib 28 is formed with a shallow pocket 23 and the foil 24 is provided just over this pocket 23 with a tab 29 fastened at 29*a* by a weld or the like. Lifting of this tab 29 will therefore break the line 27 above the pocket 23 and then rip off the entire center of the foil 24, with separation of the weak bonds at the ribs 28 and 30. This uncovers the contents of all the compartments, which contents were nonetheless separated hermetically by the rib bonds.

Figure 12:
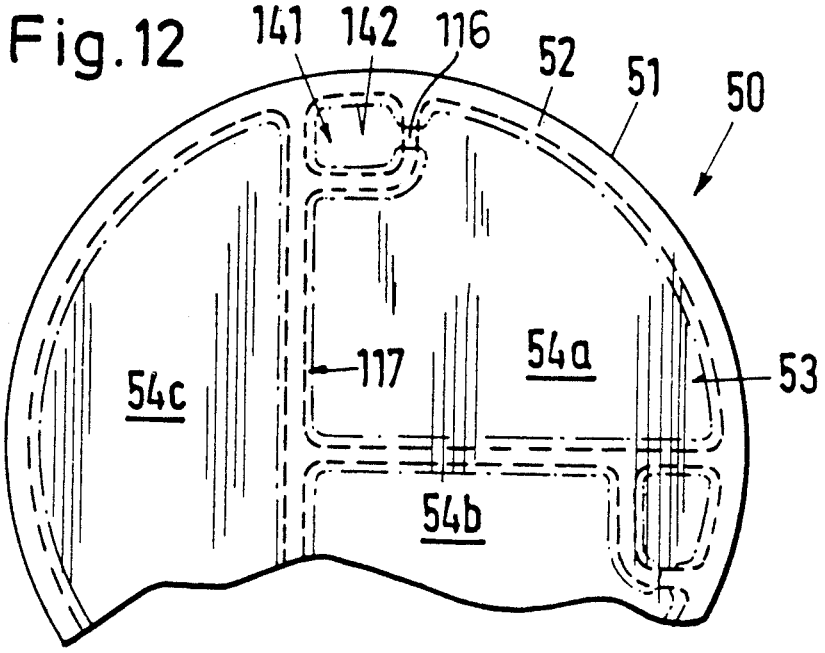

FIG. 12 shows a variant on the system of FIGS. 4 and 5. Here a container 50 has a rim 51 bonded at 52 to a foil 53. The vessel 50 is formed with compartments 54*a*, 54*b*, and 54*c* that are all substantially identical. The compartment 54*a* is associated with a tab 141 delimited by a tear line 142 substantially like that of FIGS. 15 and/or 16. A separate pocket under the tab 141 allows it to be pushed in and then ripped up over a thin rib section 116 as seen in FIGS. 13 and 14.

Figure 8:
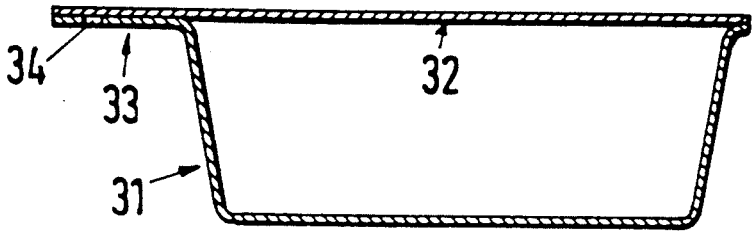
FIG. 8 is a vertical section through yet another package in accordance with the invention.
Figure 9:
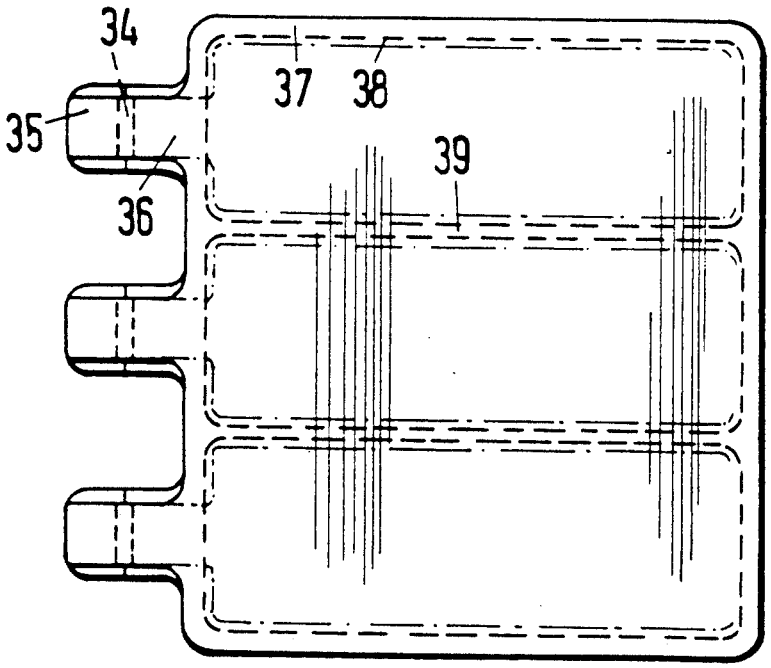
FIG. 9 is a top view of the package of FIG. 8.
Figure 10:
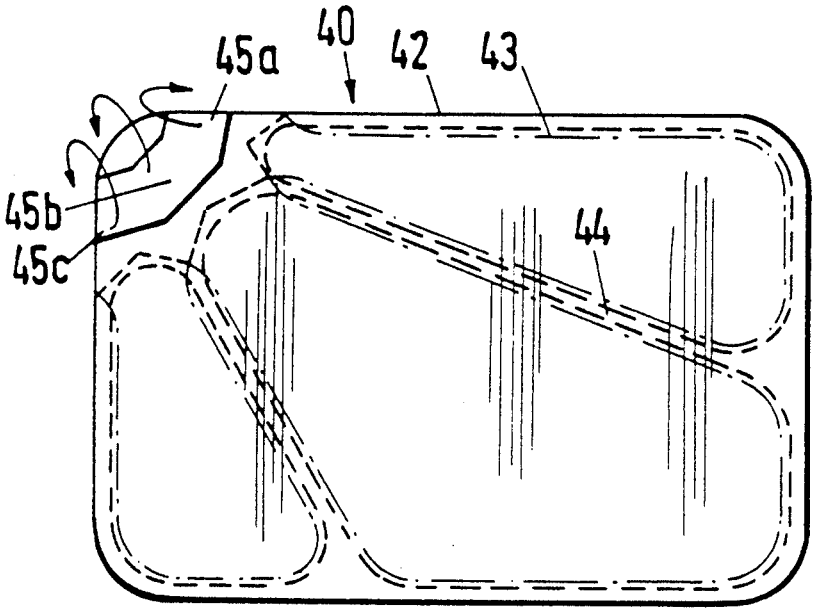
FIGS. 10, 11, and 12 are top views of another package according to this invention.

In FIGS. 8 and 9 a vessel 31 separated by ribs 39 into three compartments is provided with a single cover foil 32 formed around each compartment with a tear line 38 and bonded to the rim 37 of the vessel 31. Adjacent each compartment the vessel 31 is formed with an extension flap 33 having an outer end 35 delimited by a slot or weakening line 34. In addition each tear line 38 is extended along the sides of a foil tab 36 bonded to the entire respective flap 33. Thus to open one of the compartments, the flap end 35 is raised to snap it loose, and then the tab 36 is peeled up and the respective foil section is pulled out inside the respective tear line 38, thereby exposing the contents of the package.

Figure 11:
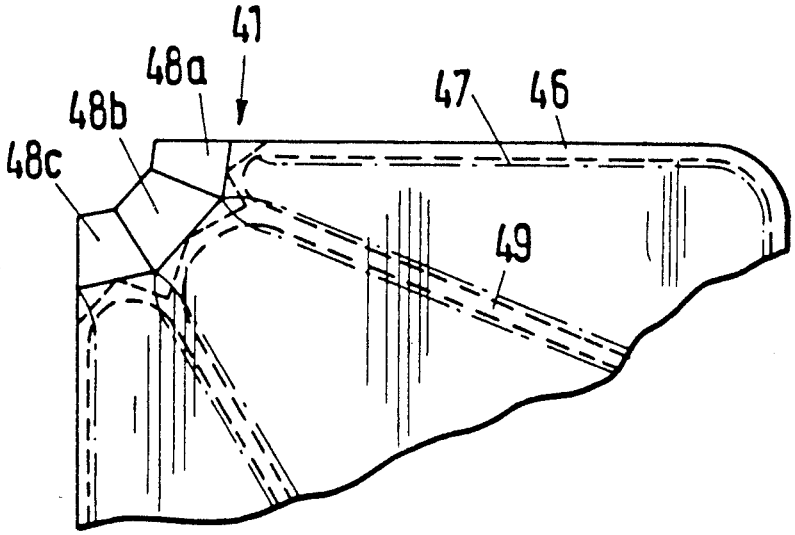

In FIG. 11 the open tab regions lie inside the outline of the package right next to one another and are separated from one another by weakening lines. The outer ends of the open tabs can be peeled from the underlying rim extension of the vessel of the container 40. The resistance to separation along a seal line 42 is lessened in the junction between the seal lines 42 and 44 and the open tabs 45*a* to 45*c* in the manner described in FIGS. 13 to 16. Each removable foil section is delimited by a respective tear line 43 and these tear lines extend right up to and form the open tabs.

In FIG. 11 the tabs 48*a* to 48*c* are separate from one another, that is they are not supported on an underlying portion of the vessel. Otherwise this package 41 and its hot-seal lines 46 and 49 and tear lines 47 are constituted as described above.

We claim:

1. An easy-open package comprising:

a vessel having an annular peripheral rim and at least one crosswise rib together forming a plurality of upwardly open compartments, the rim and rib having generally coplanar upper edges;

a foil engaging the upper edges of the rim and rib of the vessel, formed around each compartment with an annular tear line extending around the rim, and provided with an open tab attached to the foil within each tear line, one of the tabs being unitarily formed with the foil and being defined between extensions of the respective tear line, the one tab extending over a rib separating the compartment of the respective tear line from an adjacent compartment; and respective rim and rib hermetic bonds securing the upper edges of the rim and rib to the foil.

2. The easy-open package defined in claim 1 wherein the holding power of the rim bonds is substantially greater than the holding power of the rib bonds.

3. The easy-open package defined in claim 1 wherein vessel is formed with an auxiliary rib forming the adjacent compartment and having an upper edge bonded to the foil immediately outside the tear-line extension defining the one tab.

4. An easy-open package comprising:

a vessel having an annular peripheral rim and at least one crosswise rib together forming a plurality of upwardly open compartments, the rim and rib having generally coplanar upper edges;

a foil engaging the upper edges of the rim and rib of the vessel, formed with a tear line extending around the rim, and provided with an open tab attached to the foil within the tear line; and respective rim and rib hermetic bonds securing the upper edges of the rim and rib to the foil, the holding power of the rim bonds being substantially greater than the holding power of the rib bonds.

5. The easy-open package defined in claim 4 wherein the foil is formed with an annular such tear line around each such compartment and is provided within each tear line with a respective such open tab.

6. The easy-open package defined in claim 5 wherein least one of the tabs is an independent element anchored to the foil within the respective tear line.

7. The easy-open package defined in claim 5 wherein at least one of the tabs is unitarily formed with the foil and is defined between extensions of the respective tear line.

8. The easy-open package defined in claim 5 wherein each tear line of each compartment has two extensions extending over the rim of the vessel to an outer periphery and flanking the respective tab, the tabs overhanging the rim of the vessel.

9. The easy-open package defined in claim 8 wherein the vessel rim is formed with respective flaps underlying and bonded to the tabs.

10. The easy-open package defined in claim 9 wherein the flaps immediately border each other and are fastened to each other.

* * * * *